United States Patent [19]

Westrick

[11] 4,210,244

[45] Jul. 1, 1980

[54] CARRIER AND HANDLE THEREFOR

[76] Inventor: Dale R. Westrick, 9041 W. Herbison Rd., Grand Ledge, Mich. 48837

[21] Appl. No.: 935,892

[22] Filed: Aug. 23, 1978

[51] Int. Cl.[2] ..... B65D 85/54

[52] U.S. Cl. ..... 206/373; 206/370; 206/548; 150/12; 190/57

[58] Field of Search ..... 206/366, 553, 369, 370, 206/371, 372, 373, 813, 806, 815, 548; 150/12; 190/57

[56] References Cited

U.S. PATENT DOCUMENTS

| | | | |
|---|---|---|---|
| 1,094,009 | 4/1914 | Parkhurst | 206/373 |
| 1,441,251 | 1/1923 | Steffens | 206/373 |
| 3,019,952 | 2/1962 | Brewster | 190/57 |
| 3,180,485 | 4/1965 | Nevitt | 206/370 X |
| 3,606,137 | 9/1971 | Kugler | 150/12 |
| 3,675,843 | 7/1972 | Polansky | 190/57 |
| 3,836,068 | 9/1974 | Schwartzkopf | 150/12 |

FOREIGN PATENT DOCUMENTS

| | | | |
|---|---|---|---|
| 827997 | 3/1952 | Fed. Rep. of Germany | 206/370 |
| 224437 | 12/1977 | Fed. Rep. of Germany | 206/806 |
| 1235869 | 5/1960 | France | 190/57 |
| 2363298 | 3/1978 | France | 190/57 |
| 216360 | 5/1924 | United Kingdom | 150/12 |

*Primary Examiner*—Herbert F. Ross

*Attorney, Agent, or Firm*—Miller, Morriss and Pappas

[57] ABSTRACT

A carrier as for tools, luggage and the like in which the carrier base is flexible fabric arranged for rolling or folding and in which a tab extending from the outer surface of the carrier base and substantially midway of its ends forms a handle when extended through an aperture provided at one end of the carrier base. A mechanically interlocking relationship is established between the handle tab and one apertured outer end edge of the base as by the use of a commercially available material such as "Velcro". Pockets or compartments are provided on the inner side of the base material in support of objects or things to be rolled up or folded in the carrier.

4 Claims, 5 Drawing Figures

CARRIER AND HANDLE THEREFOR

The present invention is directed to providing a flexible fabric carrier into which things or objects may be packed, so that upon rolling or wrapping up the carrier, a simple fastening occurs at the handle without the need for the attachment of hardware clasps, or the like, and which fastening occurs at the closure of the carrier in resisting unrolling or unfolding of the carrier unless desired by the user.

In particular, the type of carrier set forth herein finds maximum utility in tool carriers as lightweight substitutes for tool chests for repairmen, mechanics and the like who must locate their tools adjacent a point of use but guarding against chipping or marring of porcelain, cabinets, enamel, or other decorative surfaces. In such an environment the fabric carrier isolates the tools or contents of the carrier from the surfaces in avoidance of marring. In addition, the weight of the empty carrier is low in relationship to the materials in the carrier. The handle of the present invention is non-metallic and no clasps or latches are required which might scratch or mar contacting surfaces.

Accordingly, the principal object of the present invention is to provide a lightweight carrier with simple and non-metallic handle lock and which includes carrier and handle adapted to be applied for use in a wide variety of wrap-around or roll-up luggage pieces.

Another object is to provide a carrier which does not easily chip or mar surfaces upon which it is placed when in use and which includes unique resistance to crushing.

Still another object is to provide a roll-up pocketed or compartmentalized carrier with integral handle means and simple handle interlock.

Other objects, including simplicity, economy and durability for carriers will be further appreciated as the description proceeds.

BACKGROUND OF THE INVENTION

Roll-up and wrap-around carriers and luggage are relatively well known and pocketed or compartmented fabric carriers have been used by mechanics and craftsmen for many years in protection of tools and easy access for their use. Simple examples are seen in fabric and vinyl string closed tool pouches. The major advantage is in lightweight and easy adaptability to carrying a wide variety of tools and things. The fabrics were originally duck and canvas and now, in some instances, leathers, velvets and synthetic leathers and fabrics. When applied to tools, the usual closures for such carriers were strings that were secured to the carrier material. Also straps, rope, or detachable handles were applied and belts or straps encircling the rolled or folded carrier were common. The closest device known to applicant and showing a high point in the development is found in the U.S. Pat. No. 1,094,009 to A. C. Parkhurst. This Parkhurst structure forms a hollow core into which tools may be placed and in which a brace (for example) becomes a handle and secured to the wrapped encasement by encircling leather straps.

IN THE DRAWINGS

GENERAL DESCRIPTION

In general, the present invention comprises a carrier for rolling or folding made from a flexible elongate base element having a relatively smooth or unbroken exterior side and having a compartmented interior side. One end of the base includes an aperture and the outer edge of the apertured end is stiffened or rigidified, the outer edge forming the outer margin of the aperture. On the outer (smooth) side of the base and between the two ends of the base is a handle tab in the form of a bale-like extension stitched or otherwise secured to the base and configured to be extended through the aperture as the base is wound on itself in a helix form. Upon extending the handle tab through the aperture, the handle allows the carrier to be manually carried. The flexible character of the base element allows the carrier to conform to varying quantities and sizes or configurations of contents, as needed.

Means are provided to secure the handle tab from chance removal from the aperture and the preferred means is in avoidance of marring as by wrapping the outer margin of the aperture with a loop pile material forming a grip coating. Then, just below the handle and on the handle tab, a grip coating engaging material in the form of spicules having barbed ends is secured. Then, upon insertion of the handle tab into the orifice or aperture and hefting the carrier by the handle, the barbed material is driven into the grip coating and lockably but removably engages the grip coating in prevention of chance withdrawal of the handle tab from the aperture. Thus, the engagement materials are non-metallic and secure the carrier from unrolling or unfolding when dropped or thrown down as at a work site or in a truck. At the same time when it is desired to open the carrier, the two coating and engaging materials are manually separable until reengagement. The carrier can also flex to accommodate a wide range of contents and the formation of the compartments provides a unique crush resistance.

The carrier cannot scratch or mar surfaces on which it is placed and the contents of the carrier, such as tools, do not engage the surfaces upon which they are placed.

SPECIFIC DESCRIPTION

Figure 1:
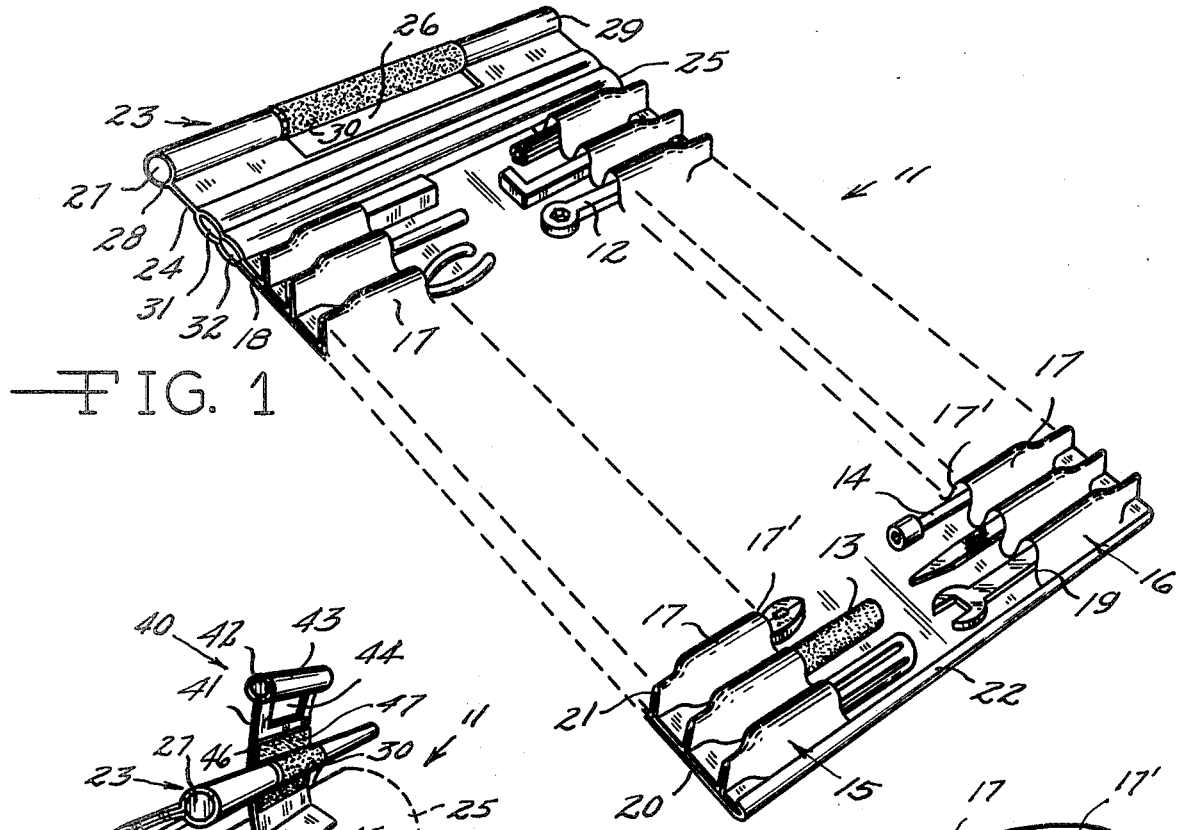
FIG. 1 shows a carrier in accord with the present invention in perspective unrolled condition.

The invention is best described by reference to the attached drawings and commencing with the FIG. 1. In FIG. 1, the carrier 11 of the present invention is illustrated as a carrier for tools 12, 13 and 14 which removably rest in facing rows 15 and 16 of pockets or compartments 17. The open ends 17' of the pockets 17 face inwardly and are spaced apart from the longitudinal center line (as unfolded) of carrier 11. Preferably the tools 12, 13 and 14 are elongate and the pockets or compartments 17 are sized to suit the type of implement which is stored therein.

The rows 15 and 16 of compartments 17 are formed by fabric strips 18 and 19, respectively, which are stitched, riveted, welded, bonded or otherwise fastened to the elongate flexible fabric base 20 along the longitudinal edges. The fabric of the base 20 may be canvas, duck, twill, or synthetic woven or sheet materials as vinyls, polyesters, nylon or the like. By humping the strips 18 and 19, the pockets 17 are formed in the spaced apart facing rows 15 and 16. The outer ends of the pockets or compartments 17 are closed as by fastening such as by stitching, welding, riveting, bonding or cementing to form a vertical supportive end closure and spine 21 which extends transversely inwardly from the base 20 in assisting definition of the pockets 17 and in assistance of the support of tools 12, 13 and 14 in a cushioned manner upon rolling of the carrier 11 and in prevention of the tools 12, 13 and 14 falling out of the ends of the carrier 11 when rolled up. On rolling, as will be seen in FIG. 2, the spines 21 define radial extensions supportive against crushing. The inner terminal end 22 of the base element 20 is rolled and secured in a finished end seam, as shown.

The outer rigid end 23 is apertured between the longitudinal edges 24 and 25 of the carrier 11 and the aperture 26 is defined by the fabric of the base 20 on three sides, as shown, and by a stiffener rod 27 which passes through loops 28 and 29 in the base material 20. A very satisfactory rod 27 comprises a simple and lightweight wooden dowel rod. A coating of gripping material 30 such as looped pile material (as, for example, one of the materials forming a fastening known commercially as "Velcro") is secured to the stiffened end 23 adjacent the aperture 26. In securing the base material 20 over the rod 27, plural stitching is used and gapped to form cylindrical compartments 31 and 32 across the base 20 for holding bar-like items, as desired, and the thus folded base material 20 is then secured beneath the pocket forming strips 18 and 19. This strengthens the outer portion of the carrier 11 and the pocketing material, as shown.

Figure 4:
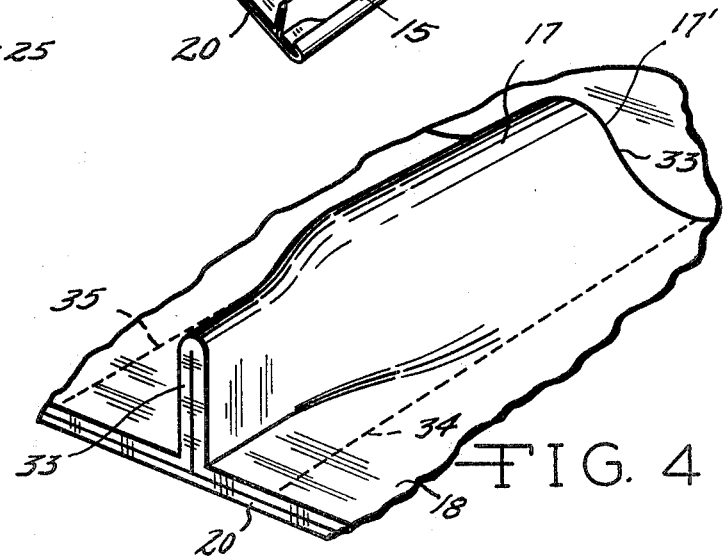
FIG. 4 is an enlarged fragmental perspective view of the closed end of a pocket or compartment.

By reference to FIG. 4, the formation of the compartments or pockets 17 from the strips 18 and 19 can be seen. The inner and outer edges 33 of the pockets 17 are rolled inwardly or trimmed smooth and the stitches 34 and 35 provide a tubular open ended case. Then the end spine 21 is formed by pinching closed the outer end of the compartment 17 and by fastening it as by cement impregnation and clamping, riveting, stitching, or other means. The cementing or bonding and clamping is preferred because it also tacks and rigidifies the longitudinal edges 24 and 25 of the carrier 11 by adding a bond to the base material 20 and hence increasing the total scuff resistance. As will be appreciated, by varying the gap between stitching 34 and 35, the sizes of the compartments 17 may be varied and that variation extends also to the amount of stock in the strips 18 and 19 humped between the rows of stitching 34 and 35.

Figure 2:
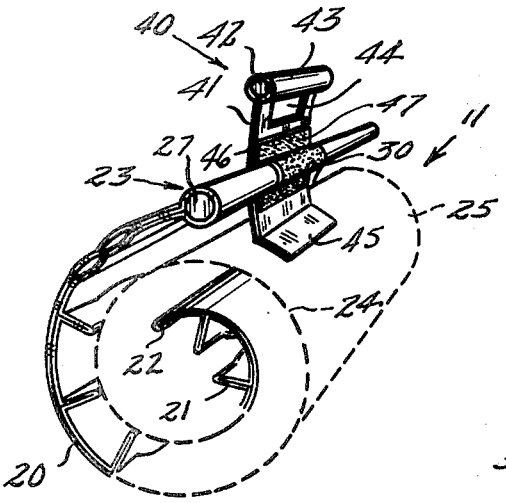
FIG. 2 is a perspective view of the device shown in FIG. 1 in which the carrier is rolled upon itself leaving one end exposed. Then the handle tab is extended through an aperture in the outer end of the carrier.
Figure 3:
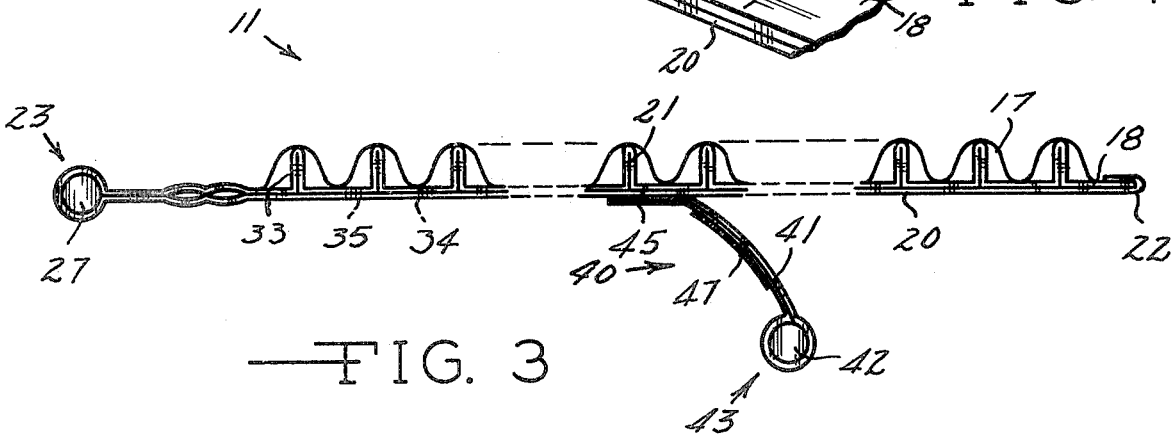
FIG. 3 is a side elevation view of the carrier seen in FIGS. 1 and 2 and showing the handle tab intermediate the ends of the carrier and indicating the closed ends of the pockets or compartments.

In FIG. 3 the profile configuration of the carrier 11 is dramatized and the handle tab 40 is best appreciated as located between the outer stiffened end 23 and the inner end 22 of the base material 20. By reference to the FIG. 3 it will be appreciated that the handle tab 40 is also located between the longitudinal edges 24 and 25 of the base material 20, and on the side of the base material 20 opposite the pockets 17. The handle tab 40 comprises a reinforced fabric plate 41 sewn upon itself and around the handle rod 42 and forming a handle 43 with the finger aperture 44. A good lightweight bale or handle rod 42 is from a hard wood dowel rod. A foot portion 45 of the tab 40 is directly secured to the outer surface of the base material fabric 20 so that a selected area gives strength and stress distribution from handle pull to fabric 20. The securing is preferred to be by stitching and bonding or cementing or combinations of these and without inclusion of externally exposed rivets. The strap portion 46 of the handle tab 40 includes a pad 47 of grip material such as the barbed spicules of the material known commercially as "Velcro" and which pad 47 material is located to impinge itself upon the material 30 at the end of the base 20 in a non-metallic secure clasp as the tab 40 is passed through the aperture 26 at the outer end of the carrier 11. Thus, the handle 43 is comfortable for the lifting and carrying of the carrier 11 and its contents and the carrier 11 is secured against unrolling until manual disengagement of the "Velcro" type fastening is achieved. This is best illustrated in the FIG. 2 showing the inner end 22 as helix wound and with the spines 21 of the pockets 17 providing a radial cellular cushion in support and protection of the tools 12, 13 and 14 inside of the carrier 11. By reason of the design of the pockets 17, the tools and contents do not tend to escape from the ends of the carrier 11 as rolled up in FIG. 2 and the handle 43 achieves a closure connection that resists premature unrolling.

Figure 5:
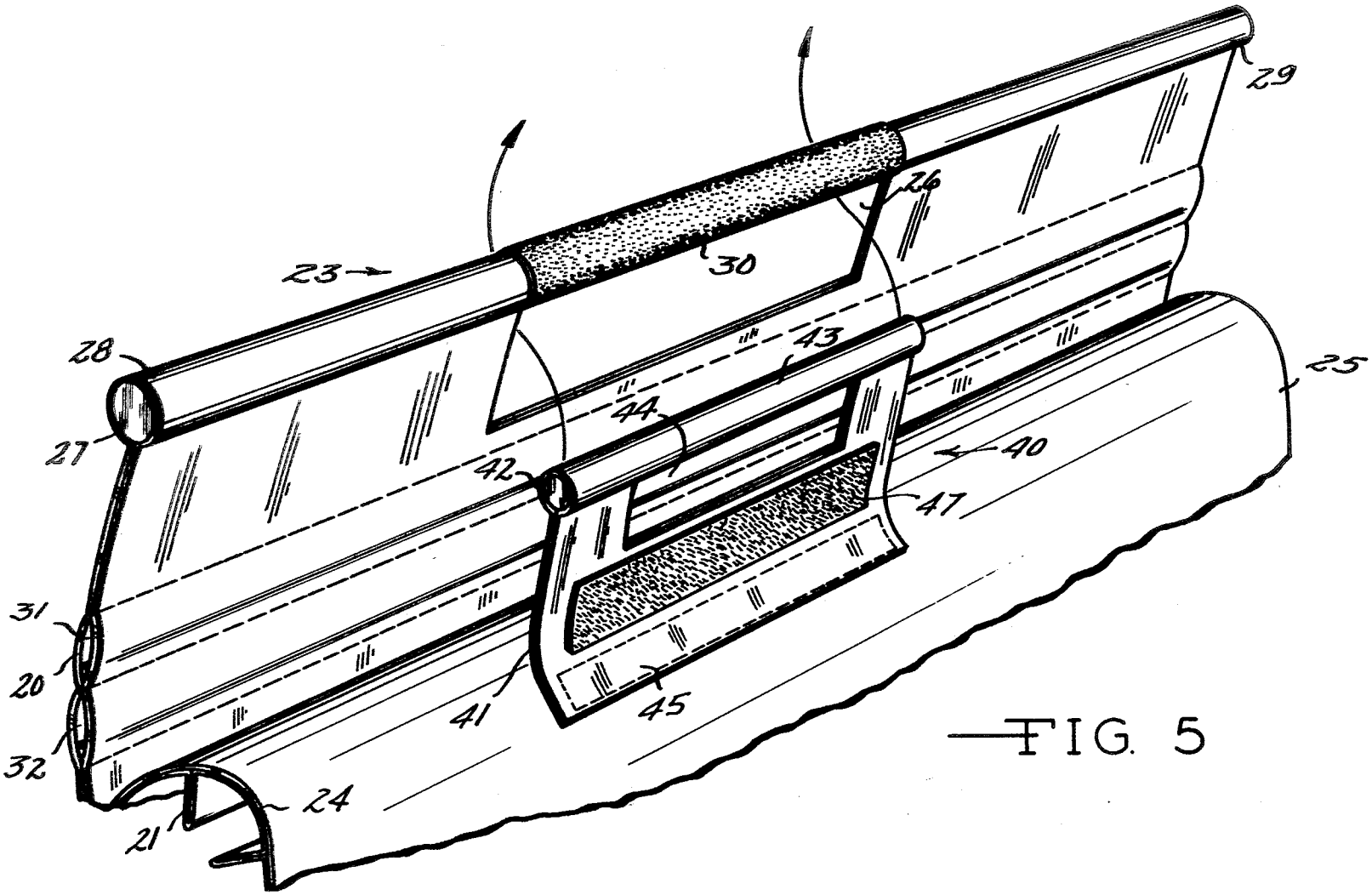
FIG. 5 is a perspective fragmented view showing how the closure of the carrier of the present invention is achieved and with the female receiving material at the aperture and the grabbing material at the handle tab in the present invention.

In FIG. 5 the details of the handle connection as between handle tab 40 and stiffened end 23 is best appreciated. It will be appreciated that the materials 30 and 47 may be reversed without departure from the invention herein. When the tools are all sheathed, the carrier 11 is rolled up, the handle tab 40 is extended through the aperture and the tools are stored in easily transported fashion.

The carrier 11, as described, resists marring of subject matter worked on since it includes no external metals and no metal exposure of parts or tools occurs. Thus, the tools and carrier can be unrolled on the hood of an automobile or cabinet without endangering the finish. The structure is light and flexible in canvas or other fabric and/or sheet and fabric-like material and the handle structure is unique as applied to carriers and the spine form of pocket closure is highly advantageous.

Having thus described my invention and at least one preferred embodiment thereof, those skilled in the art will appreciate changes, modifications and improvements therein and such changes, modifications and improvements within the skill of the art are intended to be included within the spirit of the present invention limited only by the scope of my hereinafter appended claims.

I claim:

1. In a carrier or the like, the combination comprising:

a resilient elongate base element;

a handle tab secured to said base element intermediate the ends thereof and projecting from said base intermediate the edges of said base, said tab including a grip surface; and a handle receiving aperture defined at one end of said base element and including a rigid end edge of said base element and said handle aperture having a grip surface impinging said grip surface of said handle tab when said tab is passed through said aperture and said surfaces are pressed into contact.

2. In a carrier or the like, the handle combination comprising:

a resilient elongate roll-up base element having compartments on one side;

a handle tab secured to said base element intermediate the ends of said base element and projecting outwardly from said base;

a handle receiving aperture defined at one end of said base and including a rigid end edge of said base and through which aperture said handle tab is extendable;

a grip coating on the rigid end edge of said base at said aperture; and a strip of grip coating engaging material secured to said handle tab and positioned to lockably engage said grip coating when said handle tab is passed through said aperture.

3. In the combination as set forth in claim 2 wherein said handle tab in said aperture results in a crushing surface engagement between said grip coating and said grip coating engaging material in excess of line contact.

4. In the combination of claim 3 wherein said coating is a crushable looped pile material and where said grip coating engaging material is a barbed pile material, said barbed pile material interlocking with said looped pile material on engagement in resistance to separation.

* * * * *